US006273471B1

(12) United States Patent
Zanardi

(10) Patent No.: US 6,273,471 B1
(45) Date of Patent: Aug. 14, 2001

(54) BOOK STRUCTURE

(75) Inventor: Rodolfo Zanardi, Padova (IT)

(73) Assignees: Zanardi Editoriale S.p.A. (IT); Gallimard Jeunesse (FR)

( * ) Notice: Subject to any disclaimer, the term of this patent is extended or adjusted under 35 U.S.C. 154(b) by 0 days.

(21) Appl. No.: 09/554,243

(22) PCT Filed: Jul. 20, 1998

(86) PCT No.: PCT/FR98/01587

§ 371 Date: Aug. 1, 2000

§ 102(e) Date: Aug. 1, 2000

(87) PCT Pub. No.: WO99/25564

PCT Pub. Date: May 27, 1999

(30) Foreign Application Priority Data

Nov. 14, 1997 (IT) ..... PD97A0262

(51) Int. Cl.[7] ..... B42D 15/00

(52) U.S. Cl. ..... 283/63.1; 283/61; 281/38; 281/3.1; 281/2

(58) Field of Search ..... 283/63.1, 61, 62, 283/34, 56; 281/15.1, 21.1, 38, 2, 5, 7, 3.1

(56) References Cited

U.S. PATENT DOCUMENTS

| | | | | |
|---|---|---|---|---|
| 715,162 | * | 12/1902 | Schwartz | 281/38 X |
| 1,778,766 | * | 10/1930 | McMichael | 281/38 |
| 3,843,113 | * | 10/1974 | Schaffer | 281/38 X |
| 4,618,166 | | 10/1986 | Hsi . | |
| 4,975,011 | * | 12/1990 | Holmbers | 281/38 X |
| 5,685,569 | * | 11/1997 | Chou | 281/38 |

* cited by examiner

*Primary Examiner*—Willmon Fridie, Jr.
(74) *Attorney, Agent, or Firm*—Smith, Gambrell & Russell

(57) ABSTRACT

The invention concerns a book structure which includes, assembled under one cover, a certain number of bound pages, some of which at least include leaflets with the dimensions exceeding those of the cover, with the external part of each section glued to corresponding adjacent leaflets and having, relative to the reading direction, at least one vertical folding line coinciding with the straight line of the book back to define the adjacent surfaces, and at least a horizontal folding line for covering the external element of the overlap of the lower and/or upper part of the coverings surface of the book cover.

5 Claims, 3 Drawing Sheets

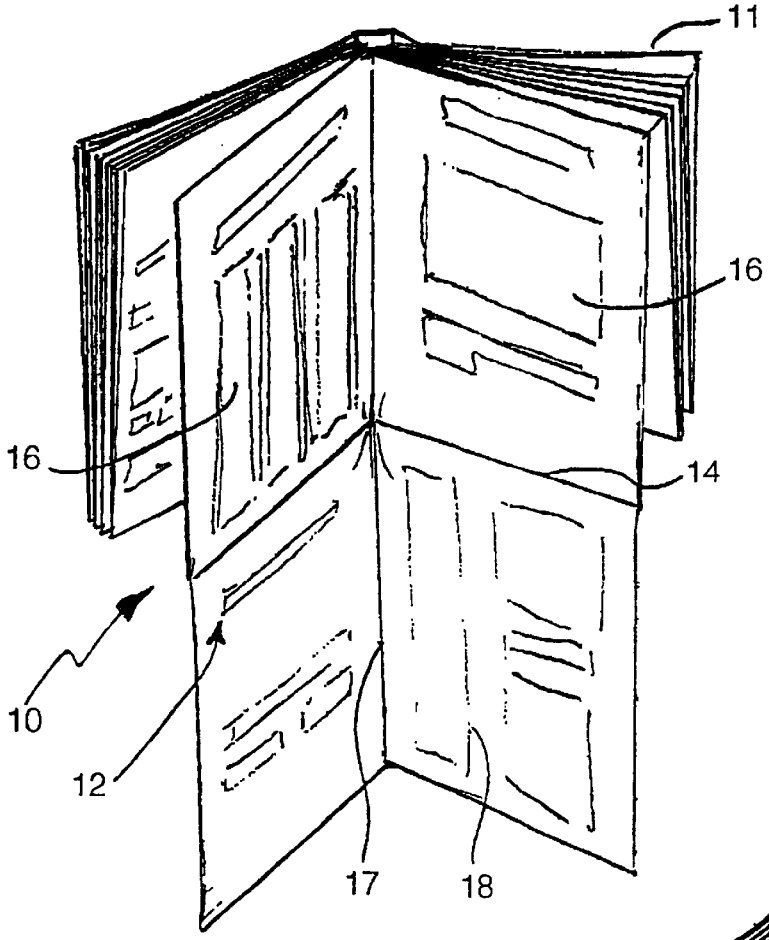
FIG.1
FIG.2
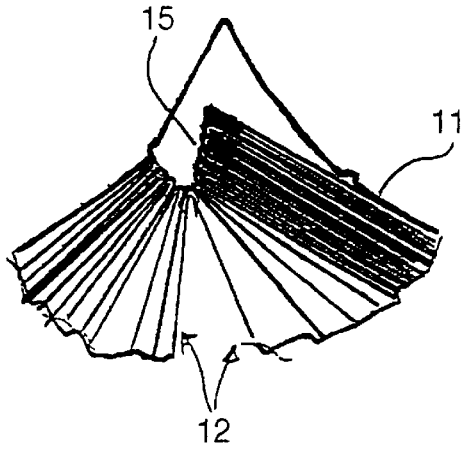
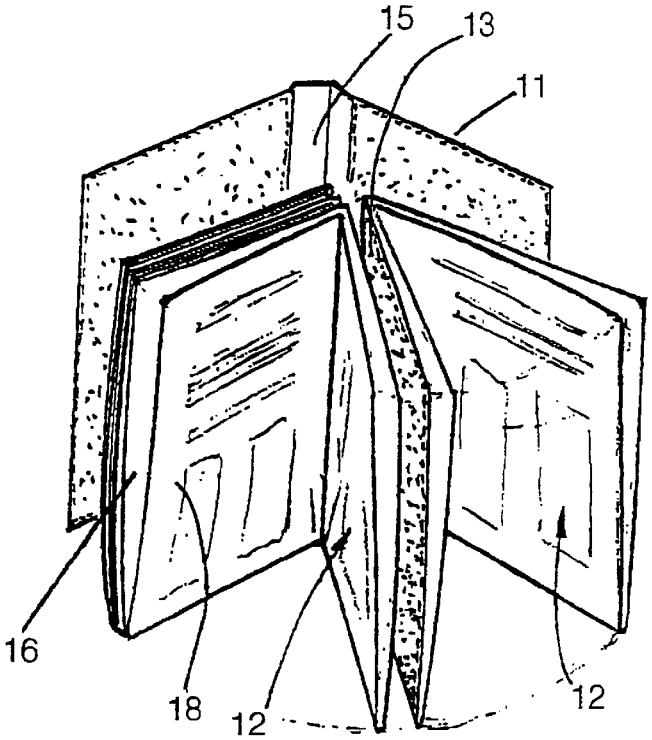
FIG.3

FIG.8
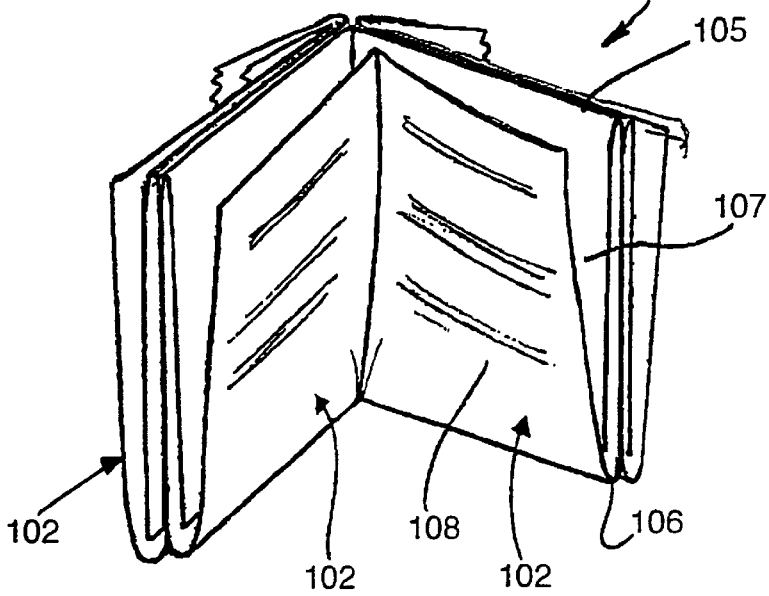
FIG.9
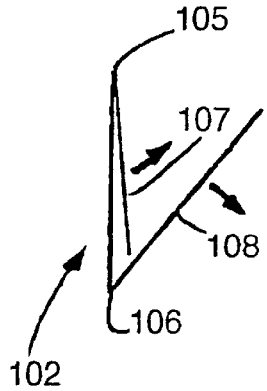
FIG.10
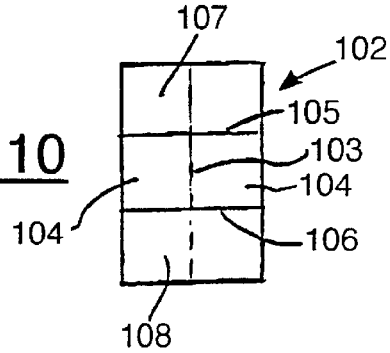
FIG.11
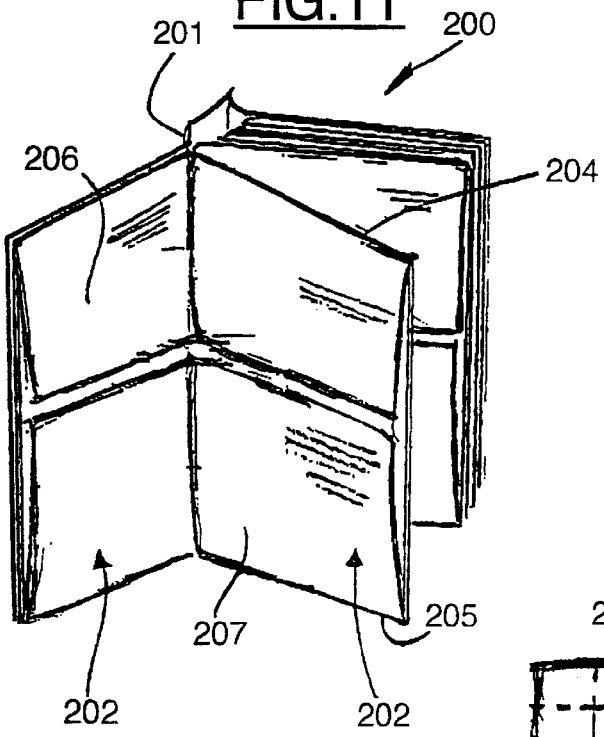
FIG.12
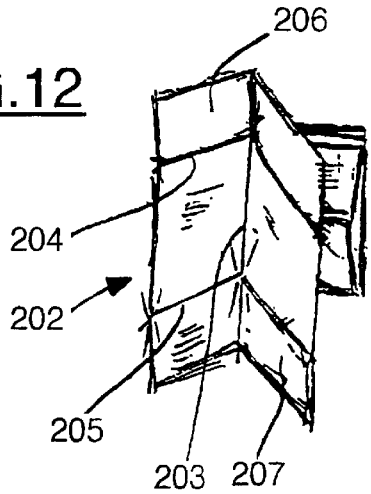
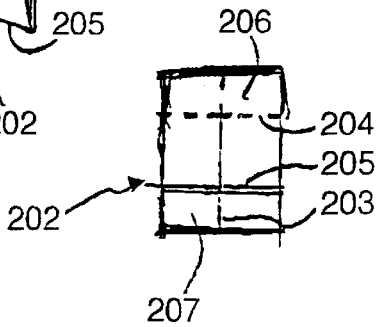
FIG.13

BOOK STRUCTURE

BACKGROUND OF THE INVENTION

The present invention relates to a structure for a book.

As has been observed in the publishing industry, it is often necessary to satisfy two contradictory requirements.

On the one hand a book is to have given dimensions, and on the other pages are to be produced with printed illustrations or text for which a suitable view requires rather large page formats.

This is particularly true in the publishing of childrens' books and in the publishing of hand or pocket manuals.

BRIEF SUMMARY OF THE INVENTION

The main object of the present invention is to provide a structure for a book that meets two contradictory requirements: small overall dimensions of the book, and the ability to contain folios of large dimensions.

To comply with the main task, one of the objects of the present invention is to provide a structure for a book in which those folios whose dimensions extend beyond those of the cover of the book can be simply and quickly consulted by the user.

Another object of the present invention is to provide a structure for a book that can be produced easily with automated technical processes.

Another object of the present invention is to provide a particularly robust book structure suitable for use in pocket manuals or for traveling.

A further object of the present invention is to provide a structure for a book that is particularly versatile in terms of the areas of use to which it can be put.

The next, but not the last, object of the present invention is to present a structure for a book that can be produced with proven technology.

The main task, the intended objects and those which will appear more clearly in the continuation of the present document, will be brought together in a structure for a book characterized to include the following elements, assembled in a cover: a certain number of bound pages, at least some of which consist of folios whose dimensions extend beyond those of the cover, the exterior part of each section (mark) being pasted to the adjacent corresponding folios and possessing, with respect to the reading direction, at least one vertical fold line coinciding with the straight line of the back of the book in order to define two adjacent faces, and at least one horizontal fold line designed for folding in the parts extending beyond the bottom and/or top whose surface area is covered by the cover.

BRIEF DESCRIPTION OF THE DRAWINGS

The other features and advantages of the present invention will be presented principally by describing three of its embodiments, which are illustrated, by way of guidance and without implying any limitation to their scope, in the attached sheets of plans and figures, in which:

FIG. 1 is an axonometric view of a book with a structure according to the present invention;

FIG. 2 is an orthogonal projection of part of the book seen in FIG. 1;

FIG. 3 is an axonometric view of the book seen in FIG. 1 undergoing assembly;

FIG. 8 is an axonometric view of a book with a structure according to the invention, in a second embodiment;

FIG. 9 is an orthogonal projection of a detail of the book as seen in FIG. 8;

FIG. 10 is another orthogonal projection of the detail as seen in FIG. 9;

FIG. 11 is an axonometric view of a book with a structure according to the present invention, in its third embodiment;

FIG. 12 is another orthogonal projection of the book seen in FIG. 11; and FIG. 13 is an orthogonal projection of a component of the book seen in FIG. 11.

DETAILED DESCRIPTION OF THE INVENTION

Figure 4:
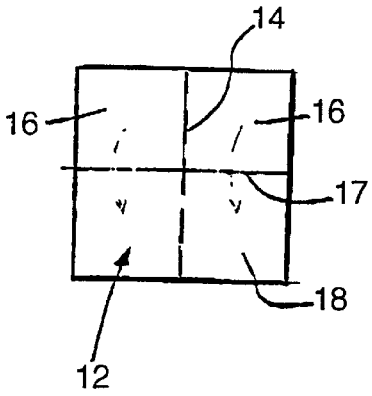
FIG. 4 is an orthogonal projection of a component of the book seen in FIG. 1.
Figure 5:
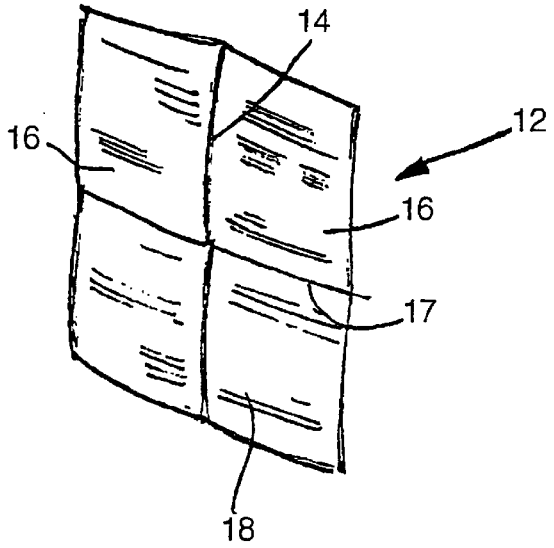
FIG. 5 is an axonometric view of the details of FIG. 4.
Figure 6:
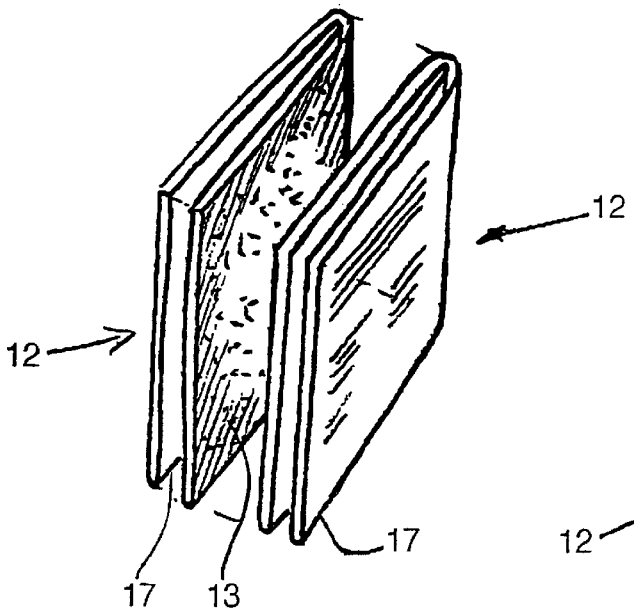
FIGS. 6 and 7 are axonometric views in orthogonal projection of the stages of assembly of the components of the book seen in FIG. 1.
Figure 7:
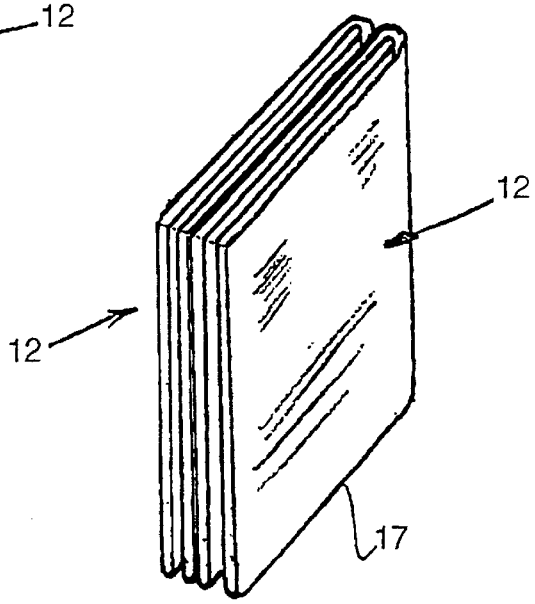

With particular reference to FIGS. 1 to 7, a book with a structure according to the present invention, in a first embodiment, is indicated as a whole by the number 10.

The book 10 comprises a certain number of bound pages assembled in a cover 11.

Each of these pages consists of a folio 12 whose dimension extend beyond those of the cover 11, the exterior part of the mark 13 being pasted to the adjacent and corresponding folio 12.

The folio 12 comprises, relative to the reading direction, a vertical fold line 14 coinciding with the straight line of the back of the book 15 to define two adjacent faces 16 and a horizontal fold line 17 designed to make it possible to fold in the extended parts 18 at the bottom of the area covered by the cover 11, allowing the folio 12 two functional states.

In particular, the folio 12 has a covered state in which it is completely covered by the cover 11, and an unfolded state in which it can also be seen from the front due to its part 18 extending beyond the bottom of the actual cover 11.

In this case, the horizontal fold line 17 substantially coincides with the lower edge of the cover 11, but in other cases it may in an exactly analogous case coincide with the upper edge of the said cover.

Referring particularly to FIGS. 8 to 10, a book with the structure according to the present invention in its second embodiment is indicated in its entirety by the number 100.

The book 100 similarly comprises, brought together in a cover not indicated in the figure, a certain number of pages, each of which consists of a folio 102 whose dimensions extend beyond those of the cover 101 and having the exterior part of the mark pasted to corresponding and adjacent folios 102. In particular, each of the folios 102 exhibits in this case, with respect to the reading direction, a vertical fold line 102 coinciding with the line on the back of the book 100 to define two adjacent faces 104 and two mutually parallel horizontal fold lines 105 and 106 designed to make it possible to fold in the respective parts 107 and 108, which extend beyond the bottom and top of the area covered by the cover 101. As in the previous case, the folio 102 has two separate functional states, one folded in in which the extended parts 107 and 108 are laid on top of each other entirely within the area covered by the cover 101, and an unfolded state in which the front of the folio 102 is visible over its entire surface area, including the extended parts 107 and 108. With particular reference to FIGS. 11 to 13, a book with a structure according to the present invention in its third embodiment is indicated in its entirety by the number 200. In this case too, the book 200 comprises a certain number of pages assembled in a cover 201, each of the said pages consisting of a folio 202 whose dimensions extend beyond those of the cover 201.

The exterior part of the mark of each of the folios 202 is pasted to the corresponding and adjacent folios 202 and the folio is provided, in the direction of the text, with a vertical fold line 203 that substantially coincides with the straight line of the back to form two adjacent faces, and two mutually parallel horizontal fold lines 204 and 205 designed to allow folding in of the parts extending outside the cover 201, both at the bottom and at the top, numbered 206 and 207, respectively.

In particular, in this case the distance between the horizontal fold lines 204 and 206 is such that, in the folded state, the lower and upper external edges of the parts 206 and 207 are adjacent.

In practice it has been found that the present invention has provided a solution to fulfill the intended task and achieve the intended objects.

Thus, it should be observed that the structure of the book according to the present invention does indeed make it possible to produce books to the intended overall dimensions, in which, nonetheless, pages consisting of even large-format folios can be bound.

The manner in which the folding of such folios allows the user to switch from the folded state to the unfolded state for use when reading and back again simply and quickly should also be observed.

It should be observed too that the structure of the book according to the present invention is particularly indicated for the production of childrens' books or pocket manuals.

The present invention is capable of modifying and changing its variables within the limits of the concept of its production.

There is no restriction on the characteristics of the materials and the dimensions within the context of the implied requirements.

What is claimed is:

1. A book structure comprising a cover having an upper and a lower edge part and an assembly of a certain number of bound pages, at least some of the bound pages comprised of folios having dimensions exceeding those of said cover and comprising horizontally arranged readable information thereon, each of said folios having:

an external part affixed to an adjacent folio;

at least one vertical folding line and at least one horizontal folding line;

said at least one vertical folding line being disposed partly along said cover and defining two adjacent faces;

said at least one horizontal folding line defining two extending parts of said two adjacent faces, so that each folio may have a folded-in state in which said two adjacent faces are covered by said two extending parts and an unfolded state in which two extending parts extend beyond said upper or lower edge part of the cover.

2. The book structure of claim 1, wherein at least one horizontal folding line is located parallel and adjacent to said upper edge part of the cover.

3. The book structure of claim 1, wherein at least one horizontal folding line is locate parallel and adjacent to said lower edge part of the cover.

4. The book structure of claim 1, wherein at least one folio has two mutually parallel horizontal folding lines, so that in the unfolded state said folio has extending parts beyond both said lower and upper edge parts of the cover.

5. The book structure of claim 4, wherein said two horizontal folding lines are located in such a way that the upper and lower edges of said folio are adjacent when said folio is in the folded-in state.

* * * * *